United States Patent [19]

Garg

[11] Patent Number: 4,606,809

[45] Date of Patent: Aug. 19, 1986

[54] HYDROCONVERSION OF HEAVY OILS

[75] Inventor: Diwakar Garg, Macungie, Pa.

[73] Assignee: Air Products and Chemicals, Inc., Allentown, Pa.

[21] Appl. No.: 750,623

[22] Filed: Jul. 1, 1985

[51] Int. Cl.[4] ..... C10G 65/10

[52] U.S. Cl. ..... 208/59; 208/112

[58] Field of Search ..... 208/59, 57, 108

[56] References Cited

U.S. PATENT DOCUMENTS

| | | | |
|---|---|---|---|
| 1,876,270 | 9/1932 | Zorn | 208/108 |
| 3,131,142 | 4/1964 | Mills, Jr. | 208/108 |
| 3,165,463 | 1/1965 | Gleim et al. | 208/264 |
| 3,331,769 | 7/1967 | Gatsis | 208/210 |
| 3,622,495 | 11/1971 | Gatsis et al. | 208/59 |
| 3,975,259 | 8/1976 | Doelp | 208/213 |
| 4,111,787 | 9/1978 | Aldridge et al. | 208/10 |
| 4,125,455 | 11/1978 | Herbstman | 208/108 |
| 4,134,825 | 1/1979 | Bearden, Jr. et al. | 208/108 |
| 4,151,070 | 4/1979 | Allan et al. | 208/59 |
| 4,176,048 | 11/1979 | Corns et al. | 208/59 |
| 4,357,229 | 11/1982 | Bearden, Jr. et al. | 208/108 |
| 4,389,301 | 6/1983 | Dahlberg et al. | 208/59 |
| 4,424,110 | 1/1984 | Bearden, Jr. et al. | 208/108 X |
| 4,435,277 | 3/1984 | Dinh et al. | 208/108 |
| 4,451,354 | 5/1984 | Stuntz | 208/56 |
| 4,559,129 | 12/1985 | Reynolds et al. | 208/59 |
| 4,559,130 | 12/1985 | Reynolds et al. | 208/59 |
| 4,560,465 | 12/1985 | Yu et al. | 208/59 |
| 4,564,439 | 1/1986 | Kuehler et al. | 208/59 |

*Primary Examiner*—Brian E. Hearn
*Assistant Examiner*—O. Chaudhuri
*Attorney, Agent, or Firm*—Geoffrey L. Chase; E. Eugene Innis; James C. Simmons

[57] ABSTRACT

High yields of desired distillate oil are obtained by subjecting heavy oil to catalytic conversion with hydrogen at superatmospheric pressure in a temperature staged process, wherein the oil-catalyst slurry is subjected in the initial stage to a temperature in the range of 780°-825° F. (415°-440° C.) and in a subsequent stage to a temperature which is at least 20° F. higher than that employed in the previous stage, preferably in the range of 800°-860° F. (~425°-460° C.).

21 Claims, 2 Drawing Figures

HYDROCONVERSION OF HEAVY OILS

The present invention relates to the processing of hydrocarbon distillation residues and is particularly concerned with improvements in processes for hydroconversion of the heavy oils or tar sand bitumen residues obtained in vacuum and/or atmospheric distillation of crude petroleum or tar sand bitumen.

BACKGROUND OF THE INVENTION

In addition to the several fractions recovered in the initial distillation of petroleum oils or tar sand bitumen, it is common practice in the art to upgrade the heavy residium to lighter distillate material that can be used as conventional refinery feedstocks or for other useful purposes. Various methods are disclosed in the prior art for effecting such upgrading. Thus, an early patent (U.S. Pat. No. 1,876,270) discloses the conversion of higher boiling hydrocarbon oils to lower boiling compounds by reacting the charge with hydrogen in the presence of certain catalysts formed from metal compounds dissolved in the oils. The essential novelty set out in the patent was in the use of diketone compounds of the disclosed metals, particularly that of molybdenum.

Later patents disclose various metal salts of molybdenum as a means for introducing the precursor of active molybdenum sulfide catalyst into the reaction system for hydrocracking of petroleum stocks. U.S. Pat. No. 3,131,142 discloses the use of metal salts of extracted petroleum acids for this purpose, to provide concentrations of 0.1 to 1.0 weight percent of the catalytic metal based on hydrocarbon feed.

U.S. Pat. No. 3,165,463 also proposed hydroconversion operations using certain organometallic compounds dissolved in the hydrocarbon charge stock. According to the patent, these compounds are first decomposed in the presence of $H_2S$ at temperatures up to 590° F. (310° C.) before reacting the mixture in the presence of hydrogen. A later patent by one of the named inventors of the '463 patent (U.S. Pat. No. 3,331,769) advocates a process in which the catalyst system of the '463 patent is passed into a reactor containing either a fixed or ebullated bed of supported catalyst. The concentration of oil soluble metal that provides the active in situ catalyst in each of the foregoing cited patents is within the 0.1 to 1.0% (by weight) range as proposed in U.S. Pat. No. 3,131,142.

U.S. Pat. No. 3,975,259 (assigned to applicants' assignee) is directed to a process in which a vacuum residuum containing relatively large quantities of combined sulfur as well as various metallic contaminants, is desulfurized. According to that patent, a hydrocarbon conversion catalyst having a nominal particle size of less than 10 microns is suspended in the feedstock and this suspension is fed, together with hydrogen-rich gas, through a contact zone at elevated temperature and pressure and at a catalyst concentration of from 20 to 5000 ppm based on fresh feed. The patent discusses the advantages resulting from the use of the advocated very small particle size catalysts especially for residium conversion, and indicates that any of the types of catalysts generally recognized as suitable in hydroconversion of hydrocarbons may be employed in the process of the patent.

U.S. Pat. No. 4,111,787 is concerned chiefly with production of normally liquid hydrocarbons from coal.

As described in the patent, a heavy hydrocarbonaceous oil is subjected to hydroconversion in the presence of active catalyst in a first stage at a temperature in the range of 416° to 538° C. Coal is added to converted liquid oil product from the first stage and the obtained slurry subjected to a second stage treatment at a temperature in the range of 416°–538° C., to effect hydroconversion of the coal. The active catalyst employed in the first hydroconversion stage may preferably be obtained by a pretreating step, in which the oil to be charged to the first hydroconversion stage is admixed with a soluble metal salt as catalyst precursor and the mixture is heated in the presence of hydrogen at superatmospheric pressure, at a temperature in the range of 325°–415° C. to convert the soluble metal salt to the active catalyst form employed in the first stage hydroconversion. In a disclosed alternative embodiment the pretreating step may be omitted and the soluble metal salt may be dissolved directly in the oil feed charged to the first hydroconversion stage wherein the active catalyst is formed in situ.

Several more recent patents disclose processes that employ very low concentrations of finely divided metals that are active for converting petroleum residium. For example, U.S. Pat. No. 4,125,455 advocates the use of $C_7$–$C_{32}$ fatty acid salts of group VIB metals as catalysts at concentrations below 1000 ppm. The disclosed reaction is carried out by adding to the reaction mixture very low concentrations of a material such as the therein preferred molybdenum octoate. The metal salt is transformed in situ to the active catalyst.

U.S. Pat. No. 4,134,825, among a number of other related patents to the same inventors, discloses the addition of oil soluble molybdic acid or other molybdenum compounds to the reaction feed stream to form in situ the desired active molybdenum sulfide catalyst. The '825 patent employs this technique for conversion of petroleum residium. A later patent issued to these inventors, U.S. Pat. No. 4,357,229, discloses a process in which coal is added to the feed, such that the reaction mixture contains undissolved coal macerals and inorganic minerals that are formed as the coal dissolution proceeds. It is quite possible that some of the in situ metal catalyst deposits on the insoluble mineral matter (IOM). This IOM, however, is claimed to be of very small size of the order of 5 microns or smaller, which is more than an order of magnitude smaller than the size that would be retained in the reactor.

By the processes disclosed in certain of the above cited patents high yields of desired distillate oils may be obtained but the desired high yields are associated with both high accompanying production of undesirable gaseous hydrocarbons as well as high rate of consumption of expensive hydrogen.

Among the objectives attained by the present invention is the selective production from heavy hydrocarbon oils and tar sand bitumen residues, of high yields of distillate oil at relatively lower consumption of added hydrogen.

SUMMARY OF THE INVENTION

It has now been found in accordance with the present invention that high yields of desired distillate oil are obtained by hydroconversion of heavy oils or tar sand bitumen residues by a two-stage process, wherein an oil-catalyst slurry is treated with hydrogen in a first reaction stage at a temperature in the range of 780°–825° F. (415°–440° C.). The products from the first stage reaction are then treated again with hydrogen in a second reaction stage at a temperature which is at least 20° F. (11° C.) higher than that employed in the previous reaction stage, preferably in the range of 800°–860° F. (~425°–460° C.). Under the operating conditions of the invention the desired high yields of distillate oil are selectively obtained with substantially lower consumption of hydrogen than heretofore experienced in known prior art methods.

The operation in accordance with the invention will be understood and its advantages appreciated from the detailed description which follows read in connection with the accompanying drawings:

BRIEF DESCRIPTION OF THE DRAWINGS

In the accompanying drawings.

DETAILED DESCRIPTION OF THE INVENTION

Figure 1:
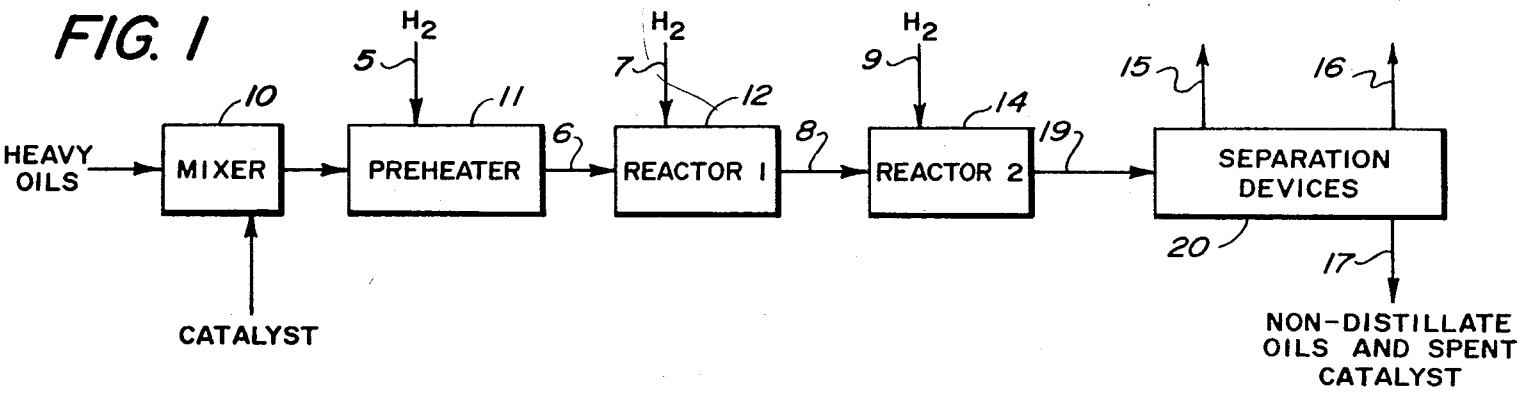
FIG. 1 is a process flow diagram for operation in accordance with one embodiment of the invention.

The process of the present invention is directed to the hydroprocessing of various heavy hydrocarbonaceous materials which usually have high metal content as well as high nitrogen and sulfur content. These materials are generally unsuitable for traditional hydrocarbon refining operations. This process of the present invention provides a method for producing liquid fuel grade values from such hydrocarbonaceous materials at an unexpectedly high selectivity.

The heavy hydrocarbon oils or tar sand bitumen residuum which can be processed in practice of the present invention generally have an API gravity at 60° F. of less than 20°. This standard utilizes increasingly smaller numbers to indicate increasingly more viscous materials. Therefore, this process is tailored to handling higher viscosity materials having an API gravity at 60° F. numerically less than or equal to 20°. Such materials include tar sand bitumen, oil sands, the residuum from traditional refining of lower viscosity hydrocarbons or petroleums, shale oils, coal derived fluids, and other heavy bituminous oils.

In any heavy oil hydroconversion process, overall conversion of nondistillable material to distillable material can be increased by either increasing the reaction temperature or residence time. However, this increase in conversion is accompanied by both high yield of hydrocarbon gases and high hydrogen consumption, making the processing scheme both unattractive and uneconomical.

In order to both reduce gas yield and hydrogen consumption, it has been unexpectedly found that by hydroconversion of heavy oils in two stages using lower temperature in first stage and higher in the second stage, both lower gas yield and lower hydrogen consumption are obtained. It also results in higher selectivity and selective production of low boiling distillate fraction.

The hydroconversion feedstock, comprising atmospheric and/or vacuum distilled heavy oils or tar sand bitumen and finely divided catalyst or oil soluble metal compound as a catalyst, is introduced into the first hydroconverison reactor through a preheater.

In the preheater, the feedstock is heated to an exit temperature of up to 700° to 750° F. (~370°–400° C.) in the presence of high hydrogen pressure. The pressure could vary from 400 to 4000 psig (28 to 273 atm.) and the residence time from 2 to 10 minutes.

Although finely divided solid catalyst can be utilized to form a slurry feedstock to the hydroconversion zone, it is preferred to introduce an oil soluble metal compound as the catalyst for the hydroconversion reaction. Preferably the catalyst in finely divided metallic form or as a compound of the metal is selected from Groups IVB, VB, VI, VII and VIII of the Periodic Table of Elements. Mixtures of such metals and metal compounds can also be used. The catalyst is used in a range of about 10 to less than 10,000 weight parts per million of the metal or metal compound calculated on the basis of the elemental metal existing in the compound in comparison to the initial charge of the heavy oil or residuum. The types of catalysts generally recognized as suitable in the hydroconversion of hydrocarbons may be employed in the process of this invention. Examples of such catalysts include: cobalt molybdate and/or nickel molybdate deposited on an alumina support, oxides or sulfides of nickel, cobalt, molybdenum or tungsten and mixtures thereof deposited or otherwise supported on alumina, silica, magnesia or aluminosilicate zeolites. Suitable finely divided catalyst may include oxides, hydroxides, elemental metal, and sulfides of metals selected from Groups IVB, VB, VI, VII and VIII of the Periodic Table of Elements. Suitable oil soluble metal compounds include inorganic metallic halides, oxyhalides, and hetropolyacids, such as phosphomolybdic acid, and molybdosilicic acid; metal salts of organic acids such as acyclic, alicyclic aliphatic carboxylic acids containing two or more carbon atoms, such as naphthenic acids; aromatic carboxylic acids, such as toluic acid, sulfonic acid, such as toluene-sulfonic acid, sulfinic acid, mercaptans, xanthic acid, phenols, di- and polyhydroxy aromatic compounds; organo metallic compounds, such as metal chelates such as 1,3 diketones, ethylenediamine, ethylenediamine tetracetic acid and phthalocyanines, as well as metal salts of organo amines, such as aliphatic amines, aromatic amines and quaternary ammonium compounds. The specific preferred catalyst is molybdenum octoate. Alternatively, other preferred specific catalysts include molybdenum and iron compounds.

In the first hydroconversion reaction stage, the feedstock is subjected to high temperature and pressure in the presence of a hydrogen atmosphere. The reaction temperature in the first stage may vary from 780° to 825° F. (415°–440° C.), more preferably from 800° to 825° F. (425°–440° C.). High pressure hydrogen may be added to the first reactor. The total pressure in the first reactor may vary from 500 to 5,000 psig (35 to 341 atmospheres), preferably from 1,000 to 3,000 psig (69–205 atmospheres), and more preferably 1,500 to 2,500 psig (103–170 atmospheres). The total reaction time in the consecutive reactions should be in the range of about 20 to 200 minutes. The reaction time in the first reaction stage may vary from 10 to 150 minutes, preferably from 30 to 120 minutes, and more preferably from 40 to 60 minutes. The reactor may be a continuously stirred vessel or a tubular reactor.

The products from the first reactor may be fed directly to the second reactor. Alternatively, the products can be flashed in a high pressure separator to remove part of the gases and light oil from it. The second reactor, once again, may be a tubular reactor or a continuously stirred reactor. In this second reactor, the first stage product is subjected to a higher temperature and at superatmospheric pressure in the presence of hydrogen atmosphere. The reaction temperature in this reactor may vary from 800° to 860° F., more preferably from 825° to 860° F. High pressure hydrogen may be added to this reactor. The total pressure, once again, may vary from 500 to 5,000 psig, preferably from 1,000 to 3,000 psig, and more preferably 1,500 to 2,500 psig. The reaction time may vary from 10 to 150 minutes, more preferably from 40 to 60 minutes. Although not shown by specific examples, it may be preferable to use higher pressure in the second reactor than in the first one.

If tubular reactors are employed both for the first and second stages, the superficial flow rates of the feedstock through the two reactors are chosen in such a way as to maintain good agitation in the reactors which ensures good mixing. The superficial gas (hydrogen-rich stream) rates will be from 0.5 to 3 ft/sec. and the superficial liquid velocity will generally be between 0.005 to 0.1 ft/sec in both reactors. Specific flows are chosen such that the feed with its incipient catalyst particles, either added as particles or formed in-situ, move through the reactors with minimal accumulation.

The total hydrogen flow rate for the hydroconversion reaction may be in a quantity of up to 25,000 SCF per barrel of feed (708 $m^3$/BBL), more preferably up to 20,000 SCF/barrel (566 $m^3$/BBL). Optimally, the total hydrogen flow rate may vary from 6,000 to 10,000 SCF/barrel (170–283 $m^3$/BBL). All of the hydrogen may be added to the preheater and subsequently passed to first and second stage reactors. Optionally, it may be divided equally in three parts or divided unequally and added to the preheater, first stage reactor and second stage reactor. Optionally, the total hydrogen flow may be divided into two either equal or unequal parts and added only to first stage and second stage reactors.

After the second hydroconversion reactor, the reactor contents are passed to a high pressure separating zone where the effluent is flashed at a temperature from 150° F. to within about 50° F. of the reactor outlet temperature, which is between 650° and 810° F. The overhead stream which comprises the gas phase includes light gases, such as hydrogen, hydrogen sulfide, carbon monoxide, carbon dioxide, ammonia, water and the $C_1$–$C_5$ light hydrocarbon gases. After initial separation, the acidic and alkaline components of the gas phase are removed and the resulting hydrogen-rich stream can be recycled to the preheater or to either or both of the reactors as at least a portion of the hydrogen atmosphere necessary for the hydroconversion reaction.

The liquid bottom stream from the phase separation following the second reactor is subjected to distillation in a vacuum distillation tower in order to recover the distillable oil product which is the desired end product of the entire process. The bottoms from this vacuum distillation step are removed as a pitch material which can be partially oxidized to a reducing gas or the pitch may be at least partially recycled to the front end of the process in order to be incorporated in the hydroconversion feedstock. The process will be explained in greater detail by reference to the accompanying drawings.

Referring now to FIG. 1, illustrating a preferred embodiment for practice of the invention, a heavy hydrocarbon oil or tar sand bitumen predistilled under atmospheric pressure or vacuum is introduced into a mixing zone 10. Atmospheric distilled feed will consist of material boiling above about 650° F., whereas vacuum distilled feed will consist chiefly of material boiling above 950° F. In the mixing zone 10, the feedstock is mixed with a catalyst. The mixture from 10 is then introduced into the preheater 11. Hydrogen is introduced into the feedstock by line 5. The preheated feedstock with catalyst suspended therein is fed to the first stage reactor 12 through line 6. Additional hydrogen is introduced to reactor 12 through line 7. The products from the first reactor are introduced to second stage reactor 14 through line 8. Once again, hydrogen may be introduced through line 9. The hydroconversion products are discharged via line 19.

The hydroconversion products are separated from a gaseous phase product which is removed in line 15 in known manner by conventional separation means 20. The gaseous phase may be cleaned up and separated into a hydrogen-rich recycle stream which may be introduced into the system via lines 5, 7 and 9. The vacuum distilled oil is removed from the separation devices zone 20 via line 16. The unconverted material (distillation bottoms), such as pitch as well as spent catalyst, is removed via line 17. A portion of this spent catalyst and bottoms material can be recycled to the front end not shown in this figure. This material may be sent to a gasifier to produce hydrogen for the hydrogen necessary for hydroconversion reaction or for the production of steam for plant power and heat.

The following comparative examples illustrate the advantages obtained by operating in accordance with the present invention, employing the advocated two stage method with higher operating temperature in the second stage. Examples 1 to 4 each were carried out under the conditions there indicated, while Example 5 is a run made by temperature staged operation in accordance with the invention. In each of the given examples the heavy oil feed corresponded to the elemental analysis and boiling range distribution reported in Table 1. In each of these examples the catalyst was initially introduced into the heavy oil feed in the form of molybdenum octoate at a concentration of 500 ppm molybdenum metal based on feed.

TABLE 1

| Analysis of Heavy Feed Oil (Mexican Moyan) | |
|---|---|
| Carbon | 83.3 |
| Hydrogen | 9.8 |
| Oxygen | 0.5 |
| Nitrogen | 0.7 |
| Sulfur | 5.7 |
| Ash | 0.2 |
| Vacuum Distillation Data | |
| <950° F. | 23.0 wt. % |
| >950° F. | 77.0 wt. % |

EXAMPLE 1

The heavy oil feed described in Table 1 was passed into a continuous stirred tank reactor operating at a total pressure of 2,000 psig (137 atmospheres) and a hydrogen flow rate of approximately 8,000 SCF/BBL (226 $m^3$/BBL) of feed. The reaction temperature was 825° F. (440° C.) and the nominal residence time 40 minutes. The reaction product distribution obtained is reported in Table 2. The conversion of non-distillable oil feed to distillable oils was 61.8% by weight. The selectivity, defined as the ratio of distillate oil produced over hydrogen consumption, was 24.9. The boiling point distribution of the distillable oils is shown in Table 2.

The effect of reaction temperature on hydroconversion of heavy oils in the presence of dispersed molybdenum catalyst is illustrated by Example 2.

EXAMPLE 2

The heavy oil described in Example 1 was subjected to hydroconversion under the same conditions as the previous example, except for the use of 850° F. (454° C.) reaction temperature instead of the 825° F. (440° C.) temperature for Example 1. The reaction product distribution is also summarized in Table 2. As will be seen from the table, conversion increased from 61.8 to 78.9% as a result of the increased reaction temperature. Selectivity (ratio of distillable oil production over hydrogen consumption) was lower than that obtained in the Example 1 run. The boiling point distribution of distillable oils was very similar to that of the Example 1 product.

TABLE 2

| | | |
|---|---|---|
| Reaction Temp. °F. (°C.) | 825 (440) | 850 (454) |
| Nominal Residence Time, Min. | 40 | 45 |
| Pressure, psig (atm.) | 2,000 (137) | 2,000 (137) |
| $H_2$ Flow Rate (SCF/BBL) | 8,645 | 9,325 |
| ($m^3$/BBL) | (245) | (264) |
| Product Distribution, Wt. % 950° F. (510° C.) Plus Material in Feed | | |
| $H_2S$ | 3.6 | 4.6 |
| $NH_3$ | 0.2 | 0.3 |
| $C_1$-$C_3$ | 4.7 | 7.1 |
| $C_4$—950° F. | 55.2 | 69.5 |
| 950° F. + | 38.2 | 21.1 |
| Water | 0.2 | 0.4 |
| Conversion, % | 61.8 | 78.9 |
| $H_2$ Consumption | | |
| Wt. % Feed | 2.22 | 3.14 |
| (SCF/BBL) ($m^3$/BBL) | 1.470 (41.6) | 2.085 (59) |
| Desulfurization, % | 50.0 | 65.4 |
| Denitrogenation, % | 18.5 | 30.4 |
| Deoxygenation, % | 38.0 | 61.1 |
| *Selectivity | 24.9 | 22.1 |
| $C_4$—950° F. Product Distr., % | | |
| $C_4$—350° F. (177° C.) | 42.6 | 40.7 |
| 350-650° F. (177-343° C.) | 37.5 | 36.3 |
| 650-950° F. (343-510° C.) | 20.0 | 23.0 |

$$\text{*Selectivity} = \frac{C_4 - 950°\text{ F.}}{H_2\text{ Consumption; wt \%}}$$

The following examples (3,4) illustrate the effect of reaction time on liquefaction of heavy oils in the presence of dispersed molybdenum catalyst (using two reactors in series at the same temperature).

EXAMPLE 3

The same heavy feed oil, as in the previous examples, was hydroconverted under the same reaction conditions as in Example 1 except for using two equal sized continuous stirred tank reactors in series to increase the normal residence time from 40 to 76 minutes. The same reaction temperature-825° F.-(circa 440° C.) was held in both reactors. The reaction product distribution obtained is shown in Table 3. The conversion of the feed oil to distillable product oils was higher than that for Example 1 but was lower than that in Example 2. Selectivity for oil production over hydrogen consumption was lower than that in both Examples 1 and 2. The amount of less desirable higher boiling fraction [650°-950° F. (343°-510° C.)] was higher than in Examples 1 and 2.

EXAMPLE 4

The operation of Example 3 was repeated using two reactors in series to provide a nominal residence time of 79 minutes. The reaction temperature in both reactors was 850° F. (=454° C.). The reaction product distribution is summarized in Table 3. As will be seen from the reported results, the conversion was higher than that obtained in Examples 1,2 and 3. Selectivity, however, was lower than that in Examples 1 and 2 but similar to that in Example 3. The desirable lowest boiling fraction of the product ($C_4$-350° F.) was lower than that obtained in Examples 1, 2 and 3 while the intermediate boiling fraction was higher than that of Examples 1, 2 and 3. The production of the least desired highest boiling distillate fraction (650°-950° F.) was higher than that obtained in Examples 1 and 2 but lower than that in Example 3.

Example 5 illustrates a run made under conditions of the present invention employing staged temperature operation.

EXAMPLE 5

The same heavy oil was charged as in the previous examples, employing the same dispersed molybdenum catalyst at a total pressure of 2,000 psig (137 atm) and at a hydrogen flow rate of 8,000 SCF/BBL (226 $m^3$/BBL). The charged oil was passed through two continuous stirred tank reactors in series at a nominal residence time of 73 minutes, with the first reactor at 825° F. (440° C.) and the second reactor at 850° F. (454° C.).

As seen from the compared results reported in Table 3, by operating under the staged temperature conditions of the present invention, higher conversion was obtained as compared with Examples 1, 2 and 3, but lower than that obtained in Example 4. The selectivity, however, was higher than that obtained in any of Examples 1 to 4. Likewise, the production of the least desirable highest boiling distillate fraction (650°-950° F.) obtained was lower than that had in Examples 1 to 4, while the production of the most desirable boiling distillate fraction (350°-650° F.) was higher than that of Examples 1-4.

Example 5 clearly shows the important economic advantages of using staged reaction temperature in the catalytic hydroconversion of heavy hydrocarbon oils from the standpoint of savings in hydrogen consumption as well as in the value of the products obtained.

TABLE 3

| | Example 3 | Example 4 | Example 5 |
|---|---|---|---|
| Reaction Temperature, °F., | | | |
| Reactor 1 | 825 | 850 | 825 |
| Reactor 2 | 825 | 850 | 850 |
| Nominal Residence Time, Min. | 76 | 79 | 73 |
| Pressure, psig (atm) | 2,000 (137) | 2000 (137) | 2,000 (137) |
| $H_2$ Flow Rate, SCF/BBL ($m^3$/BBL) | 8,682 (246) | 8,682 (246) | 7,934 |
| Product Distribution, (Wt. % 950° F. (510° C.) + Material in Feed | | | |
| $H_2S$ | 4.6 | 5.8 | 4.8 |
| $NH_3$ | 0.3 | 0.4 | 0.3 |
| $C_1$-$C_3$ | 6.8 | 9.9 | 7.7 |
| $C_4$—950° F. | 66.1 | 79.8 | 73.1 |
| 950° F. + | 24.9 | 7.2 | 16.5 |
| Water | 0.3 | 0.4 | 0.3 |
| Conversion | 75.1 | 92.8 | 83.5 |

TABLE 3-continued

| | Example 3 | Example 4 | Example 5 |
|---|---|---|---|
| $H_2$ Consumption | | | |
| Wt. % Feed | 3.06 | 3.70 | 2.88 |
| SCF/BBL ($m^3$/BBL) | 2,026 (57) | 2,452 (69) | 1,909 (54) |
| Desulfurization, % | 65.0 | 81.8 | 68.2 |
| Denitrogenation, % | 28.7 | 39.5 | 28.8 |
| Deoxygenation, % | 55.5 | 68.5 | 59.0 |
| *Selectivity | 21.6 | 21.6 | 25.4 |
| Product Distribution, % | | | |
| $C_4$—350° F. | 43.0 | 37.2 | 39.0 |
| 350–650° F. | 25.4 | 38.5 | 44.4 |
| 650–950° F. | 31.6 | 24.3 | 16.6 |

$$\text{*Selectivity} = \frac{C_4 - 950^\circ \text{ F.}}{\text{Weight \% } H_2 \text{ consumed}}$$

Any of the known types of high pressure reaction vessel may be employed for each of the several in series reactors for carrying out the temperature staged operation of the invention. Instead of distinct separate vessels connected by a conduit in series, one may employ a single shell having separated zones or sections with suitable means between the zones or sections to prevent backflow. While separate vessels or separate reaction zones are preferred with the oil catalyst mixture in continuous flow through the system, a single reaction zone may be employed in carrying out the operation batchwise, wherein the oil/catalyst mixture is first treated with hydrogen at the specified lower temperature range for the desired residence time and the temperature then raised to the second stage level for a desired fixed time period.

In FIG. 1 of the accompanying drawing a process flow diagram is shown for practice of the invention utilizing separate reactors in series. The heavy oil charged is introduced into a mixing vessel, such as a stirred tank 10, together with the catalyst (or catalyst precursor) in desired proportions and the mixture, as a solution or slurry, is passed to preheater 11 into which hydrogen or hydrogen-rich gas is introduced at a predetermined rate.

The catalyst-oil slurry is hydroconverted in reaction vessel 12. The reaction vessel 12 can be either a tubular reactor or continuously stirred tank reactor. Hydrogen gas may be added to maintain the desired pressure during the first stage reaction. The reaction mixture from 12 is passed into reactor 14 for the second reaction at the desired higher temperature. Once again, reactor 14 can either be a tubular or continuously stirred reactor. The higher temperature may be achieved by heating of the oil-catalyst slurry during passage from reactor 12 to reactor 14 or suitable heating means may be provided within reactor 14. Hydrogen is introduced to maintain the desired pressure level.

The reaction products, including "spent" catalyst discharged from reactor 14, are separated by conventional means 20 known to the art, into light gases 15 one or more distillate oil fractions 16, and a non-distillable residue 17 from which all or part of the catalytic solids may be removed by further processing.

Figure 2:
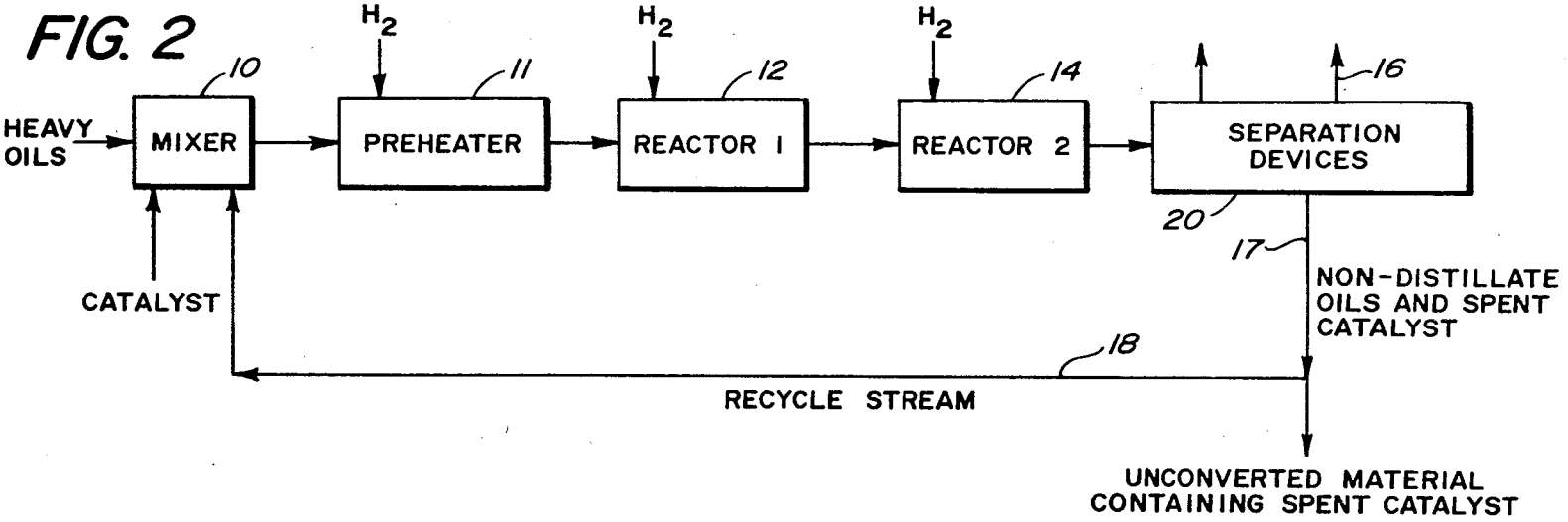
FIG. 2 is a process flow diagram of a modified embodiment.

As shown in the FIG. 2 embodiment, all or part of the slurry of non-distillate oils and spent catalyst (stream 17) may be recycled via line 18 to the mixer 10, where it is admixed with fresh heavy oil charged to the system. By doing so at least part of the previously unconverted product in line 17 is subjected to further hydroconversion and further advantage is obtained from the residual activity of the only partly spent catalyst.

What is claimed:

1. The method for hydroconversion of feedstocks consisting essentially of at least one heavy hydrocarbon oil selected from the group consisting of residue of petroleum oil distillation and the residue of tar sand bitumen distillation to enhance the recovery of 350°–650° F. boiling product fraction, which method comprises treating such feed stock with hydrogen at superatmospheric pressure and in the presence of finely divided active hydrogenation catalyst in consecutive reaction stages, wherein an initial reaction stage is carried out at a temperature in the range of 780°–825° F. and a subsequent reaction stage is directly carried out after the initial reaction stage at a higher temperature in the range of 800°–860° F., the temperature of said subsequent reaction stage being at least 20° F. higher than that of said initial reaction stage.

2. The method for hydroconversion of feedstocks consisting essentially of at least one heavy hydrocarbon oil selected from the group consisting of residue of petroleum oil distillation and the residue of tar sand bitumen distillation to enhance the recovery of 350°–650° F. boiling product fraction, which method comprises mixing an oil soluble metal compound with the feedstock and treating the feedstock with hydrogen at superatmospheric pressure in consecutive reaction stages, wherein an initial reaction stage is carried out at a temperature in the range of 780°–825° F. and a subsequent reaction stage is directly carried out after the initial reaction stage at a higher temperature in the range of 800°–860° F., the temperature of said subsequent stage being at least 20° F. higher than that of said initial reaction stage.

3. The method as defined in claim 2 wherein the liquid product contained in said subsequent reaction stage is distilled leaving unconverted distillation bottoms as a residue containing spent catalyst, at least a portion of said residue being recycled to said hydroconversion operation.

4. The method as defined in claim 2 wherein the oil soluble metal compound is a compound of a metal selected from groups IVB, VB, VI, VII and VIII of the Periodic Table.

5. The method as defined in claim 4 wherein said group VI metal is molybdenum.

6. The method as defined in claim 2 wherein said oil soluble metal compound is molybdenum octoate.

7. The method as defined in claim 2 wherein said consecutive reaction stages are performed in separate reaction zones in series.

8. The method as defined in claim 7 wherein each of said reaction stages is carried out at a total pressure in the range of 500–5000 psig.

9. The method as defined in claim 7 wherein the combined nominal residence time in said several reaction stages is from 20 to 200 minutes.

10. The method as defined in claim 7 wherein said initial reaction stage is performed at a temperature of about 825° F. and said subsequent reaction stage is at a temperature of about 850° F.

11. The method as defined in claim 2 wherein a portion of the hydrogen needed for the hydroconversion reaction is provided by separation and recovery of hydrogen-rich gas from the products formed in said subsequent reaction stage.

12. The method as defined in claim 2 wherein the heavy hydrocarbon oil is residue of petroleum oil distillation.

13. The method as defined in claim 2 wherein the heavy hydrocarbon oil is the residue of tar sand bitumen distillation.

14. The method as defined in claim 1 wherein the liquid product contained in said subsequent reaction stage is distilled leaving unconverted distillation bottoms as a residue containing spent catalyst, at least a portion of said residue being recycled to said hydroconversion operation.

15. The method as defined in claim 1 wherein the finely divided active hydrogenation catalyst comprises a metal or cation selected from groups IVB, VB, VI, VII and VIII of the Periodic Table.

16. The method as defined in claim 15 wherein said group VI metal or cation is molybdenum.

17. The method as defined in claim 1 wherein said consecutive reaction stages are performed in separate reaction zones in series.

18. The method as defined in claim 17 wherein each of said reaction stages is carried out at a total pressure in the range of 500 to 5000 psig.

19. The method as defined in claim 17 wherein the combined nominal residence time in said consecutive reaction stages is from 20 to 200 minutes.

20. The method as defined in claim 17 wherein said initial reaction stage is performed at a temperature of about 825° F. and said subsequent reaction stage is at a temperature of about 850° F.

21. The method as defined in claim 1 wherein a portion of the hydrogen needed for the hydroconversion reaction is provided by separation and recovery of hydrogen-rich gas from the products formed in said subsequent reaction stage.

* * * * *